United States Patent [19]

Turbitt

[11] Patent Number: 4,746,421

[45] Date of Patent: May 24, 1988

[54] DENSITY CLASSIFICATION OF PARTICULATE MATERIALS BY ELUTRIATION METHODS

[76] Inventor: David M. Turbitt, Apt. #3, 141 King Street East, Kingston, Ontario, Canada, K7L 2Z9

[21] Appl. No.: 753,066

[22] Filed: Jul. 9, 1985

Related U.S. Application Data

[63] Continuation-in-part of Ser. No. 568,093, Jan. 4, 1984, Pat. No. 4,554,066.

[51] Int. Cl.[4] ..... B03B 7/00

[52] U.S. Cl. ..... 209/3; 209/17; 209/158

[58] Field of Search ..... 209/3, 17, 158–161

[56] References Cited

U.S. PATENT DOCUMENTS

| | | | |
|---|---|---|---|
| 743,120 | 11/1903 | Watson | 209/159 |
| 801,200 | 10/1905 | Bailey | 209/17 X |
| 2,429,436 | 10/1947 | Walker | 209/17 |
| 2,760,634 | 8/1956 | Saxe | 209/158 X |
| 4,430,209 | 2/1984 | Merck et al. | 209/17 X |
| 4,554,066 | 11/1985 | Turbitt et al. | 209/17 X |

FOREIGN PATENT DOCUMENTS

| | | | |
|---|---|---|---|
| 102673 | 12/1906 | Canada . | |
| 373878 | 5/1938 | Canada . | |
| 451942 | 8/1936 | United Kingdom | 209/159 |

*Primary Examiner*—Andres Kashnikow
*Assistant Examiner*—Mary Beth O. Jones
*Attorney, Agent, or Firm*—Sixbey, Friedman & Leedom

[57] ABSTRACT

This specification relates to a counter-flow sedimentation separator and process which is designed to separate mixed particulate materials on either side of a present cutoff density and to a method of separating such materials. The separator has been designed to highgrade gold, zinc, tin, lead, barite and gold tailings, but can be used to perform a similar function with other materials given an adequate density difference between the materials to be separated. It employs a series of counterflow separation units used in conjunction with screening operations in such a way as to effect density separations. This process is specially provided with new and inventive embodiments which increase systems efficiency and density selectivity, while decreasing water and energy requirements.

17 Claims, 5 Drawing Sheets

DENSITY CLASSIFICATION OF PARTICULATE MATERIALS BY ELUTRIATION METHODS

This application is a Continuation in part of application Ser. No. 568,093 filed Jan. 4, 1984 (now U.S. Pat. No. 4,554,066).

This invention relates to a process and apparatus particularly applicable to the mining industry by which particles are separated according to density.

BACKGROUND OF THE INVENTION

In the mining industry many minerals such as alluvial gold, lead, zinc, tin and barite are often beneficiated at least in part by density separation systems. Present techniques such as heavy media separators, jigs, or tables can be employed to accomplish these tasks, however the cost of performing such separations on a large scale can be quite high. Other more dynamic methods such as sluice boxes must be operated on a batch process basis, and are often inefficient with respect to recovery of particles at the fine end of the particle size spectrum.

Forms of elutriation techniques have been in use in laboratories for decades where particles are classified according to diameter, as in a "Cyclo-sizer" (Trademark of Warman International). This system utilizes the differential sedimentation rates of particles with different diameters to effect separations according to size. In this application particle density must be constant in order for consistent size classifications to be made.

A patent of background interest to the present invention is U.S. Pat. No. 2,429,436, issued Oct. 21, 1947 to G. B. Walker. Walker teaches that the "dynamic sedimentation rate" of a particle, that is the rate at which a particle under the influence of gravity settles against a vertical flow of "separation medium", is determined by the partical diameter and density, and by the density and flow rate of the separation medium. (The separation medium is described as a liquid with solids in suspension.) Thus, where particles are settling at an equal rate against a given flow, the smaller particles of this group will be of relatively higher density with respect to the larger particles settling at the same rate. Walker then outlines how a screening step following the dynamic sedimentation or flow step is employed to separate the large particles from the smaller higher density particles. Thus by applying this screening step to the underflow of a given vertical flow rate, a density separation affect can be achieved, where the undersize underflow will comprise the high density material, and the oversized underflow will be of relatively lower density.

Walker further teaches how this idea can be applied to effect density separation over a wider size spectrum by starting with a relatively high separation medium flow rate in the first separation chamber such that the "sink" or underflow material which settles out is essentially comprised of only the largest of the denser particulate constituents, and thus does not require screening. In Walker's preferred embodiment, the overflow, or the "float" fraction from the first separated flows freely into a second separator in which the upward flow of the separation medium is adjusted to permit the settling of somewhat finer dense particles and the largest of the lighter particles. The sink product of the second separator is now subjected to a screening process wherein the screen mesh size is selected to allow the smaller, more dense, particles to pass while the larger less dense particles are retained. Correspondingly the float from the second separator is introduced into a third which has an even lower vertical flow velocity of separation medium such that the finer fractions in the particle spectrum can be addressed. This trend continues through the system in order to separate finer and finer fractions at each step until the system is no longer economical to operate as the mass of the remainder decreases. However, as the discharge of float from each step is approximately equal in volume to the sum of the inflow plus the vertically flowing separation medium, each step in the series must be physically larger than the previous step in order to accommodate the increasing inflow. This problem effects the economic utility of the system, and becomes especially critical when multi-separator systems are required to perform density separations over a wide size spectrum.

Walker further teaches how the density of the separation medium can be increased by suspending high density colloidal or semi-colloidal solids in the liquid being employed. By increasing the density of the separation medium towards that of the less dense material, the ratio of the diameter of low and high density particles which will settle at the same rate through such a liquid increases. This allows for the flow or elutriation based operations to be affected by partial density to a greater extent. On the other hand, both the high and low density particles will settle at a somewhat lower rate, thus the system cannot be operated at quite as high a rate.

Walker specifically describes how a high density magnetizable powder can be carefully diluted to the desired density, used as the separation medium, reclaimed by a magnetic separator, demagnetized by passing it through coils in order to prevent magnetic agglomeration, then thickened prior to redilution for reuse in the separation medium. Unfortunately, the process for demagnetizing such a material, or thickening a colloidal or semi-colloidal suspension both pose major technical problems. Further, a magnetic separation medium could cause problems during screening operations by sticking to itself, to other particles or to the screens. Walker stated that if such a magnetizable material cannot be found or employed for some other reason the same liquid weighting principles can be used, however a gravity separation system will be required to recover the weighting agent. This again presents a formidable technical problem, this being performance of gravity separation on particles which are colloidal or semi-colloidal in size. Thus utilizing a medium of this nature in order to perform a density separation simply results in having to perform another more difficult density separation.

In practice, the shortcomings of this design become more evident. Many have already been pointed out regarding the shortcomings of the process, as described by Walker, but the apparatus itself, as described by Walker, is also fraught with inherent inefficiencies, and logistical problems which will now be outlined. In his preferred embodiment, Walker illustrates and describes the series of separators as inverted cones. The angle of the apex of these cones is apparently in the range of 45 to 90 degrees, and the cones are equipped with a spigot having an outlet valve, and a "bustle" for the admission of the separation medium. Firstly, the effective area through which the separation medium flows at the desired speed or "design velocity" is at the apex of the cone, and is quite small. This area represents the effective area across which the separation is made, thus limiting it will limt the rate at which the separation can be made. Further, as the area across which the separation is being performed is so small, the design velocity will accordingly increase as the effective separation area is decreased by underflow particles passing through the area. Another problem relating to maintaining the design velocity across the effective area is that Walker includes no provision to ensure "plug flow" is achieved in the effective area. That is to say that the actual upward velocity of the separation medium will vary across the effective area of the separator. These variations in flow velocity will inevitably lead to variations in the sedimentation characteristics of the underflow and result in errors in the density classification. Another shortcoming of note is that Walker makes no provision to prevent the separation medium from simply flowing through the discharge spigot without effecting the required vertical flow through, the upper portions of the one cone as required. Therefore a considerable portion of the separation medium is not performing its designated task. The remainder of the separation medium which does flow upward quickly loses speed as the cross sectional area of the cone rapidly increases. This geometry results in a large fraction of the material to be separated remaining trapped in the upper portion of the cone since it is too small or of insufficient density to escape as underflow, but too large or dense to be floated off as overflow. Given time this situation will result in bedding of the material in the cone with channels running through the beds to allow the separation medium and the inflow to flow directly into the next cone. The obvious solution to this problem is to reduce the size of the cone such that the overflow takeoff occurs before the velocity is reduced to any appreciable extent. However, due to the variations in the design flow profile, as outlined above, early overflow of the float product would result in some of the particles, which should have been underflow, being erroneously contained in the overflow.

It is the object of this invention to effect density separations by means of combining screening operations with flow related separation steps in such a ways as to overcome the problems inherent in the apparatus such as that of Walker.

SUMMARY OF THE INVENTION

According to the present invention, there is provided a process for separating mixtures of particulate materials according to particle density. The process comprises passing the particulate materials through a series of counterflow separation units. Each unit uses the classifying effect of a flow of liquid to produce underflow and overflow fractions, with a similar one of said fractions being introduced to the next unit in the series. These counterflow separation units will consist of either elutriation columns or hydrocyclones. In elutriation columns, the mixed particulate materials settle against an upwardly flowing column of separation medium. Those particles with sedimentation velocities great enough to overcome the verical flow become the underflow fraction whereas the lighter particles, that is, those particles with a lesser sedimentation velocity are carried up as the overflow fraction. Hydrocyclones can also be employed to produce two flow fractions. The fraction discharging through the apex of the hydrocyclone can be considered the underflow, while the vortex discharge will constitute the overflow fraction. Several parameters relating to the specific dimensions and operation of the hydrocyclone will determine the relative size/density characteristics of the two flow fractions produced by the separator. These various parameters are analogous to the vertical flow rate of the elutriation column. Therefore, the concept of the "vertical flow rate or velocity" shall be employed throughout this specification in reference to any parameters which can be manipulated in order to change the size/density related separation criteria of any counterflow separation unit. The vertical or upward flow rate of the separation medium in each unit differs progressively through the series. The vertical flow velocity for each unit is selected such that materials with progressively different sedimentation velocities are contained in the underflow of each successive unit. The other of said flow fractions from each unit is subjected to a screening operation utilizing screen mesh sizes selected according to the vertical flow rate in order to pass particulate materials above some preselected density, but retain the particulate materials below that density. Where elutriation columns serve as the counterflow separation units, one or more units in the series will employ a primary extraction zone where liquid bearing solids in suspension is extracted and employed in whole or in part as the separation medium within the system.

In addition, the invention provides an apparatus for separating particulate high density materials from associated particulate materials having a lower density. The apparatus comprises a plurality of counterflow separation units in a series. The units are provided with means to pass a similar fraction from each unit into the next unit of the series and means to control the vertical flow rate in each successive unit. Each unit is provided with an outlet for discharging the fraction to be screened, and a means to collect the discharge from each unit. Screens are associated with individual units in the series where required. The screen mesh sizes being selected according to the vertical flow rate in order to pass particles above a selected density, but to retain particles of lesser density. The counterflow separation units can be elutriation columns, hydrocyclones, or a combination of the two. When elutriation columns are used as the counterflow separation units, one or more unit in the series will employ a primary extraction tank from which liquid bearing solids in suspension will be extracted and employed in whole or in part as the separation medium within the system.

The process typically begins by passing the materials to be separated through a screen into a feed hopper with a means to introduce the particulate material to be separated into an upward flowing column of separation medium contained in an "elutriation column". Where the higher density material is the desired fraction the intial flow velocity will be selected such that it does not allow even the largest particles of the waste material to settle. The rate of flow of the separation medium will depend on the size density characteristics of the particles to be separated, but the initial flow rate could be as high as 5 meters per second. The high density sink or underflow is introduced into the next classifying flow which allows smaller high density particles along with the largest waste particles to settle out by virtue of its lower flow velocity. The underflow from the second separator is screened such that the material which is underflow due to its relatively large size (low density) becomes the discarded oversize, while the undersize, being of higher density is retained. The overflow from this second elutriation column is introduced into the next column which again has a lower flow rate, and similarly the underflow is subjected to a screening process with a smaller mesh size as is required to effect the proper separation. Again it is the undersized underflow which is retained and the overflow continues to be introduced to successively lower velocity flows and finer screening processes until the overflow fraction is so fine or small that it is believed to contain so little of the desired material that the separation becomes non-economic. Generally this system is designed to separate particles which are less than ¾ inches in diameter down to particles which can pass through 400 mesh screens. Dependent on the size/density spectrum of the materials being separated the flow rates could vary between 5 meters per second for the initial flow for very large particles to 0.1 cm/sec. for the finest particles in the group. The number of steps required will depend both on the width of the size spectrum as well as the difference in the density of the two materials.

It should be noted that at the very fine end of the size spectrum the flow related separations will ideally be performed with hydrocyclones rather than the elutriation columns which cannot be operated at a high rate with very fine particles. As with the columns of the system, the hydrocyclones would be connected in series whereby a similar fraction from each step forms the inflow for the next cyclone in the series.

A "recirculation flow" in the process of the invention eliminates the need to artificially weight the separation medium by the addition of solids. In practice, the recirculation flow embodies a large diameter overhead chamber or "primary extraction tank" from the top of which liquid containing very small particles is extracted, and reintroduced into the lower portion as the separation medium. This technique uses the material being separated as the weighting agent, and thereby meets the need for a weighting agent to maximize the efficiency of the separation. Further, using this recirculation method, the overflow from one column to the next does not grow substantially as it does when this technique is not used. This precludes the necessity of having to increase the physical size of each successive separation column, which is a serious problem when dealing with a wide particle spectrum requiring many steps. This also allows standardization of the columns of the apparatus across successive steps. This standardization will also permit mass production, simplify replacement of worn sections in the field, and simplify modifications required for the system to separate materials with different size/density distributions. Therefore, by avoiding the use of artificial weighting agents, no secondary separation process is required to recover the weighting agents.

An alternative weight technique which can be used is to dissolve some compound in the liquid. For example, where the chemisitry of subsequent benefication steps permits, calcium chlrodie (a relatively inexpensive chemical) could be dissolved in water, bringing the solution's density above 1.35 grams per cubic centimeter before adding suspended solids to further weight the medium. This action would result in a two-fold weighting effect, firstly by increasing the effective liquid density, but also by allowing larger size solids to remain in suspension. Finally, if this technique is employed, the system could be operated at a much lower ambient temperature due to freezing point depression, a property which may be of some benefit in certain climates.

A typical example of the apparatus might consist of an interconnecting series of elutriation columns with decreasing flow rates such that the overflow from each column is introduced into the next column of the series. Valves and meters used to control the recirculation pumps are one way to control the recirculation flow in the columns and thus ensure that each column has a successively lower flow than the last. When hydrocyclones replace elutriation columns in performing the flow related separations they will also be connected in series. Control over the characteristics of the hydrocyclone separation can be achieved by an adjustable solids extraction mechanism which can control the discharge flow rate. As the size of hydrocyclones is effectively limited, in some cases it may become necessary to use more than one series of hydrocyclones connected in a parallel manner to one another in order to process large volumes of material.

Ideally an apparatus utilzing columns would employ a constant feed, and be designed to effect separations across a wide size spectrum, at a high rate with good density selectivity at a low expense. Some of the embodiments employed to achieve these goals will be summarized below by way of example. It will however be understood that it is not intended to limit the invention to such embodiments. On the contrary, it is intended to cover all alternatives, modifications and equivalents as may be included within the spirit and scope of the invention as defined by the appended claims.

The specific geometry of the columns allows for a narrowing of the cross sectional diameter just below the "primary separation section", where the separation medium is to effect the separation. This configuration aids in maximizing the plug flow characteristics through the primary separation section, thereby giving the system better density selectivity. The lower portion of the columns consists of the sedimentation chambers. The recirculation flow enters the column at the primary sedimentation chamber, then flows up into the primary separation section. The secondary sedimentation chamber being located below the primary sedimentation chamber does not have a large vertical flow rate within, thus the underflow can settle to the bottom of the secondary sedimentation chamber where the solids are removed. A progressive cavitation pump is ideal for this purpose as it can remove the underflow with a minimum of associated liquid loss, while at the same time operating at a known volume per time, thereby allowing the liquid loss to be compensated for. Immediately above the primary separation section is the "secondary separation section". It is in this section that the material being separated is introduced into the vertical flow of separation medium. The diameter of the secondary separation section is selected to be sufficiently larger than that of the primary separation section so that the vertical flow in the secondary portion is slightly lower than the design velocity for that column. This slight reduction in velocity is designed to prevent any underflow particles from erroneously reporting to the overflow, while at the same time minimizing the residence time for the overflow material within the column. At the top of the secondary separation section is the overflow line which takes the overflow from a given column and introduces it into the next column or separator in the series. Above this point is located the "primary extraction tank" which is comprised of a rapid increase into a larger diameter chamber. The primary extraction tank is designed to reduce the vertical velocity enough so that most solids will remain near the bottom, and eventually be introduced into the next column. At the top of this tank, liquid with solids in suspension is extracted and pumped back into the system via the primary sedimentation chambers. Thus, this liquid with solids in suspension serves as the separation medium. The relative size of the solids remaining in suspension will depend on the vertical flow rate of the liquid in the primary extraction tank, which will in turn depend upon the internal diameter of the tank, and the rate of extraction from the tank.

In order to prevent any of the separation medium (liquid containing suspended solids) from contaminating the underflow from which the final product will be screened, some method of "scrubbing" can be employed. One method is to add some "clean" liquid to the secondary sedimentation chamber. A restriction in diameter at the top of this chamber ensures a vertical flow of sufficient magnitude to prevent any of the undesired solids from settling out. (In this instance "clean" liquid refers to liquid which has an acceptally small amount of solids contained in the liquid.) One possible method of obtaining this "clean" liquid is through the use of "secondary extraction tanks". In another embodiment hydrocyclones could be employed to extract liquid with a minimum of suspended solids. By locating each hydrocyclone such that the recirculation pump feeds the tangential inlet, and by using valves to control the two discharge apertures, the majority of the volume will discharge through the apex and be used as separation medium, while the volume extracted through the vortex finder will be used as "clean" scrubbing liquid. Another possible method of scrubbing entails introducing the separation medium via an upwardly directed nozzle such that the medium will plume out to the full diameter of the column just inside the lower section of the primary separation section. Thus, only those weighing particles involved in eddy currents near the edges of the column will settle out as all others will be carried up by the vertical flow. These solids which do settle out can then be separated from the true underflow via a double screening technique; for example, in a case where the higher density material is the desired product, the contaminated underflow is subjected to the appropriate screening operation which will result in an oversize discard product, and a contaminated undersize concentrate. This concentrate can then be rescreened using a finger mesh size selected to retain the density concentrate, and pass the contaminant which had been suspended in the recirculation flow. It should be noted that in this second method some of the material may be lost, and the velocity profile across the critical portion of the column may be adversely affected. In various circumstances, economics may favour one method of scrubbing over the other, or perhaps parts of both methods might be utilized within the same system.

The system used to introduce the inital slurry feed to the first separation column will consist of a hopper with a constant outflow rate as effected by an auger or progressive cavitation pump. The inflow solids may then be diluted with water from the "main holding tank" to form a slurry with a known solids to liquids ratio. The "main holding tank" mentioned above embodies a large tank into which all waste liquid such as the final overflow is returned. In most cases, some form of thickener will be employed to remove most of the suspended solids in the water entering the main holding tank.

Often the intial feed rate for the first column may prove too high for the columns down the series to accommodate the high inflow. That is, the velocity in the secondary active portion will become too high in comparison with the primary active portion. To remedy this situation it will be necessary to reduce the overflow volume at certain spots throughout the system. Again this can be easily accomplished through the use of a secondary extraction tank, where the required volume reduction can be achieved by diverting a portion of the cyclone overflow back to a main holding tank. In the example embodiment sumarized above all recoverable liquids are sent back to the main holding tank, thus the absolute minimum liquid requirements for the system will be that amount of liquid which cannot be economically recovered from the solids which constitute the concentrate, the overflow fines, and the coarser discard materials.

BRIEF DESCRIPTION OF THE DRAWINGS

In drawings which illustrate example embodiments of the invention.

Figure 1:
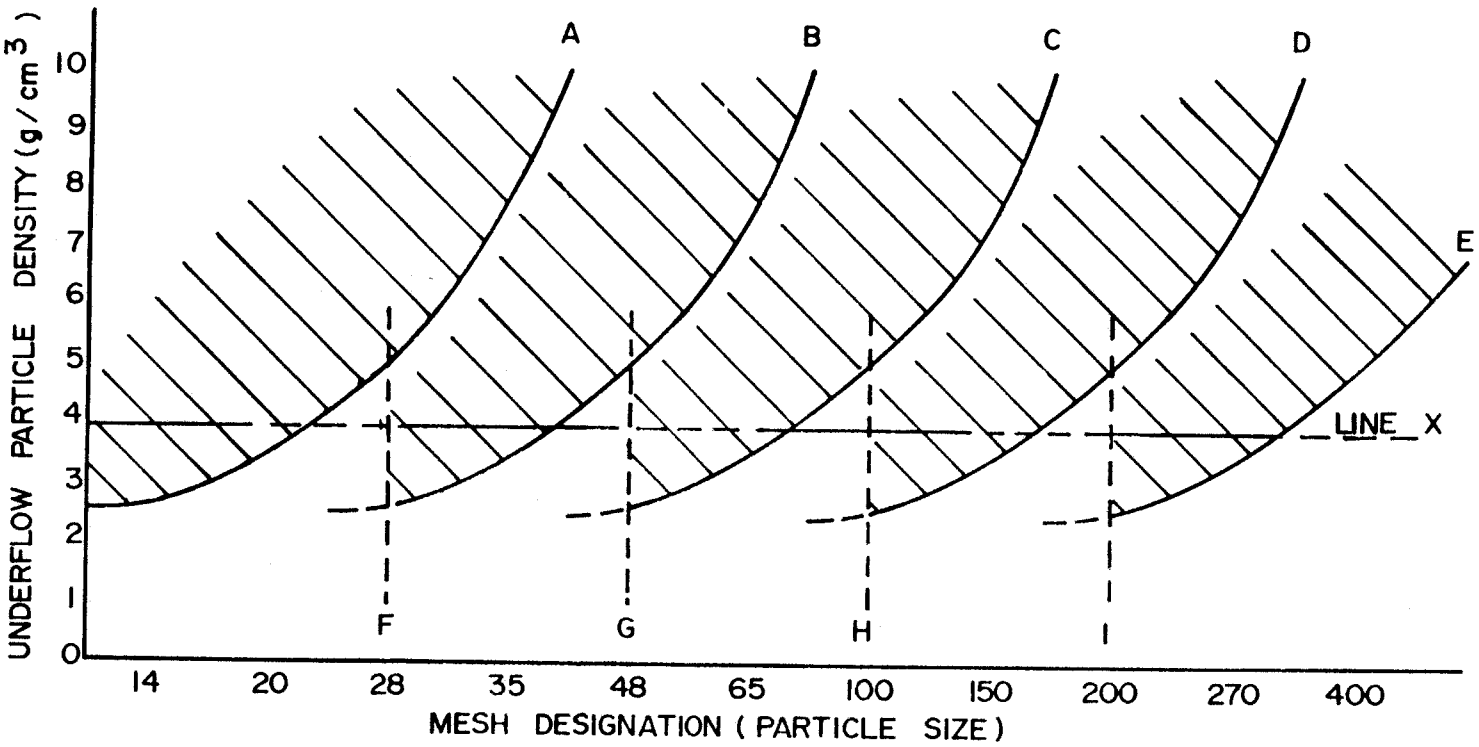
FIG. 1 is a graph illustrating typical theoretical design considerations used to set flow rates, to decide how many columns should be employed, and to decide where screening procedues should be employed in the apparatus and process of the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

The elutriation process described here refers to a type of dynamic counter-flow sedimentation in which the solid pariculate material settles against a vertical flow of liquid separation medium. Particulate materials of differing densities are restricted size ranges, generally less than ½ inch in particle diameter, are ideally suited for density classification by elutriation methods. The purpose of the design is to effect such density classification on the described materials via an economically desirable application of the elutriation method.

The theoretical principles on which this system operates will initially be discussed in terms of separating two mixed particulate materials. It will further be assumed for the purpose of the following explanation of the principles affecting the operation of this system that the desired particles have a density of 5 g/cm$^3$, and the waste particles have a density of only 3 g/cm. However, it shall be understood that the specific values included in this explanation are included only for the purpose of explaining the operating principles which affect this process, and that the process is not limited to this specific method of application or to materials as described above. Alternative methods of employing the principles of the process will be described later in this specification.

Sir Isaac Newton described the settling velocity of a spherical particle through a liquid with the equation:

$$v^2 = \frac{4\,dg(\rho_s - \rho_l)}{3\,Q\,\rho_l},$$

where "v" is the settling velocity, "d" is the particle diameter "g" is the acceleration due to gravity, "ρs" is the density of the solid particle, "ρl" is the density of the liquid, and "Q" represents an experimentally determined constant related to the characteristics of the separation medium. (The value of "Q" for pure water is in the order of 0.40) As applied to the eluriation process, the value of "v" is issued to select the vertical flow rate of the separation medium such that particles of a given density "ρs", and a desired diameter "d" will be at terminal velocity within the rising liquid, and therefore, effectively suspended. Particles of greater diameter or density will drop to the bottom as underflow, and particles of a lesser size or density will be washed away by the separation medium, as overflow. Thus the elutriation method can be used to perform particulate separations with respect to size or density as long as the other variable (ie density or size) is a constant within that group of particles.

In practice, Newton's equation holds roughly true only in predicting the terminal velocity of particles generally greater than 14 mesh in size. Settling characteristics of particles finer than about 65 mesh are best described by Stoke's Law:

$$v = \frac{d^2\,g(\rho_s - \rho_1)}{18\mu}$$

where "μ" represents the viscosity of the separation medium in units consistent with the other variables. All other variables in Stoke's Law represent the corresponding physical characteristics as employed in Newton's description of the phenomenon. Settling characteristics of particles which are too small to fall in the Newtonian range, but too large to be in the Stokesian range, can be determined experimentally. These particles are said to be in the transition settling range. With respect to separations of very fine particles (generally less than 150 mesh) the sedimentation rates are so slow that separating large volumes becomes problematic as large cross-sectional areas are required. Therefore hydrocyclones are used to perform flow separations in this size range. As with Stokes Law, the particle diameter to density relationship relavent to hydrocyclone separations is also an inverse square function, and thus hydrocyclones can serve the same function as elutriation columns in performing density separations. Thus, for particles with different size/density characteristics, different methods may be required to calculate the terminal velocity. Nevertheless, it is true across the entire size spectrum that as the density of the separation medium approaches that of the lower density material, the relative diameter of low density particles at terminal velocity increases with relation to the diameter of the higher density particles also at terminal velocity in a given flow. This effect is due to the "(ρs−ρl)" term of the equations, which approaches zero sooner when applied to the lower density solids than when "ρs" has the higher value associated with the more dense particles. Applying this principle, under Stokesian conditions, to particles with high versus low density, where all particles are subjected to a vertical flow of separation medium (with differing density values), the following table can be generated:

| Separation Medium Density | High:Low Density Ratio of Particle Diameters |
|---|---|
| 1 | $\sqrt{4} : \sqrt{2}$ |
| 2 | $\sqrt{3} : \sqrt{1}$ |
| 2.75 | $\sqrt{2.25} : \sqrt{0.25}$ |

As the values indicate, by increasing the density of the separation medium, the density difference between the two types of materials has a more pronounced affect on particle diameter. Since it is the function of the flow related steps in the system to effect separations where the underflow is composed of relatively smaller high density particles mixed with relatively larger low density particles, the differences in size are best accentuated by using a hgher density separation medium. This increase in the ratio of high versus low density particle diameters facilitates the screening steps which follow each elutriation step in order to effect the density classification.

The principles outlined above can be employed to make density classifications by combining flow and screening steps as described. However there will inevitably be a certain amount of error associated with the classifications as the specific sedimentation characteristics for some particles will deviate from predictions due to things such as variation in the velocity profile, or the variations in shape of the specific particles involved. In general these variations lead to a normally distributed error curve being superimposed on the desired separation. In terms of FIG. 1 this would be represented as a certain amount of uncertainty or fuzziness associated with the curves. This becomes a serious problem when a high degree of system selectivity is required to separate two materials with a small density difference. The selectivity of the apparatus will be inversely proportional to the variance of this error distribution, however additional treatment effects can yield vast improvements in total system efficiency.

Additional treatment effects, as alluded to above, may vastly improve the total system sensitivity to particle density as the additional treatments reduce what is known in statistical terms as the Type II error. Once such additional treatment which might be employed would be to take advantage of the shorter time it takes for high density particles to approach terminal velocity. This principle, on which jig separations rely, could also cause a density related settling ratio increase thereby increasing the density selectivity of this system. The actual modification to the present system which would be required to make use of this additional treatment effect could be as simple as using a pulsating pump on the recirculation flow line. Of course this is just one possible method of application of this idea, and many other methods of adding this effect are possible. Also mentioned earlier was the effect variations in particle shape could have on increasing the error distribution. In fact, in certain cases the differences in friability between the desired and the waste product can lead to a consisant difference in particle shapes. In some cases, the screens employed can be selected to have opening shapes which will favour passing one product more than the other. Again this fact can be used to increase system selectivity.

Alternative methods of application of the principles of the process include such things as starting with the low flow rates, and screening the overflow from each stage while the underflow is introduced to the next higher flow. Again at the next stage the overflow is screened such that the overflow/oversize is the lower density material, and the undersize is the high density product. Another variation of the application of the principles set forth is to effect the screening procedures first, then introduce the various size fractions to the classifying flows of separation medium. It should also be pointed out that the system can be employed in cases where the lower density material is the one which is desired, and the high density material is the waste. In these cases simple modifications of the apparatus and system, obvious to anyone skilled in the art can be made to save the low density product and discard the high density product. It should also be evident to anyone skilled in the art that this system is not limited to separations involving materials of only two densities, in fact by using double or multiple screening decks for each underflow product, the system can separate as many density fractions as desired. For example, one screen yields two density fractions; two screens (the larger mesh on top of the the smaller) will result in the lowest density as the oversize, the middle density fraction on the second screen, and the highest density material passing both screens. Finally, in instances where the density separations must be made only at the very fine end of the size spectrum, elutriation columns could be abandoned completely in favor of a series of hydrocyclones. When one series of hydrocyclones could not process the required volume, an additional series of hydrocyclones could be employed to operate in a configuration parallel to the first series.

These variations on the inventive concept, as outlined above, can be combined with one another resulting in compounded variations of applications of the inventive idea. However, all such variations are considered within the scope of this patent.

Turning to FIG. 1, ideally line "X" represents the desired density separation line. In practice, however, separations as along line "X" must be approximated as indicated by the shaded areas both above lines A through E, where these areas represent the size/density characteristics of the underflow products from successive elutriation columns, and to the right of the vertical dashed lines, "F" through "I" where these lines represent the screening steps appropriate to each underflow fraction. In this example application of the system, it is the undersize/underflow which is the high density material which is being beneficiated, thus the particles left of the screen lines would be discarded as waste. The curved lines, A through E, are approximations to the solutions of the settling equations given earlier where the vertical flow rate "v" of a separation medium with a density of 2 g/cm$^3$ is set and the size/density line represents characteristics of particles with terminal velocity "v". All the curves asymptotically approach the density of the separation medium itself, and decreasing the flow rate has the effect of broadening the curve to the right. As the flow rate is decreased to zero, the parabola is flattened into a straight line along the density of the separation medium. It should be noted that although increasing the density of the separation medium does increase the settling ratio, the particles will not settle as fast, therefore the system cannot be operated at as high a rate. Shaded areas below the density value of 3 would indicate that particles with those size/density characteristics would erroneously be classified with the high density product. Similarly, non-shaded areas above the value of 5 would be indicative of the desired high density material being discarded. In any given application, the related operating parameters of rate, contamination and efficiency must be weighed against each other in order to use the system to its best advantage under the circumstances at hand. It will also be noted that the underflow of the first elutriation step is not indicated as being subjected to a screening step. In many cases this may be the case as the feed into the system may already have been reduced to some limited size. In these cases the screening step has effectively been performed prior to the first elutriation step. In other cases, where only a very small portion of the particle population will report to this underflow, and the majority of these particles are of the higher density material, screening may be deemed unnecessary.

Figure 2:
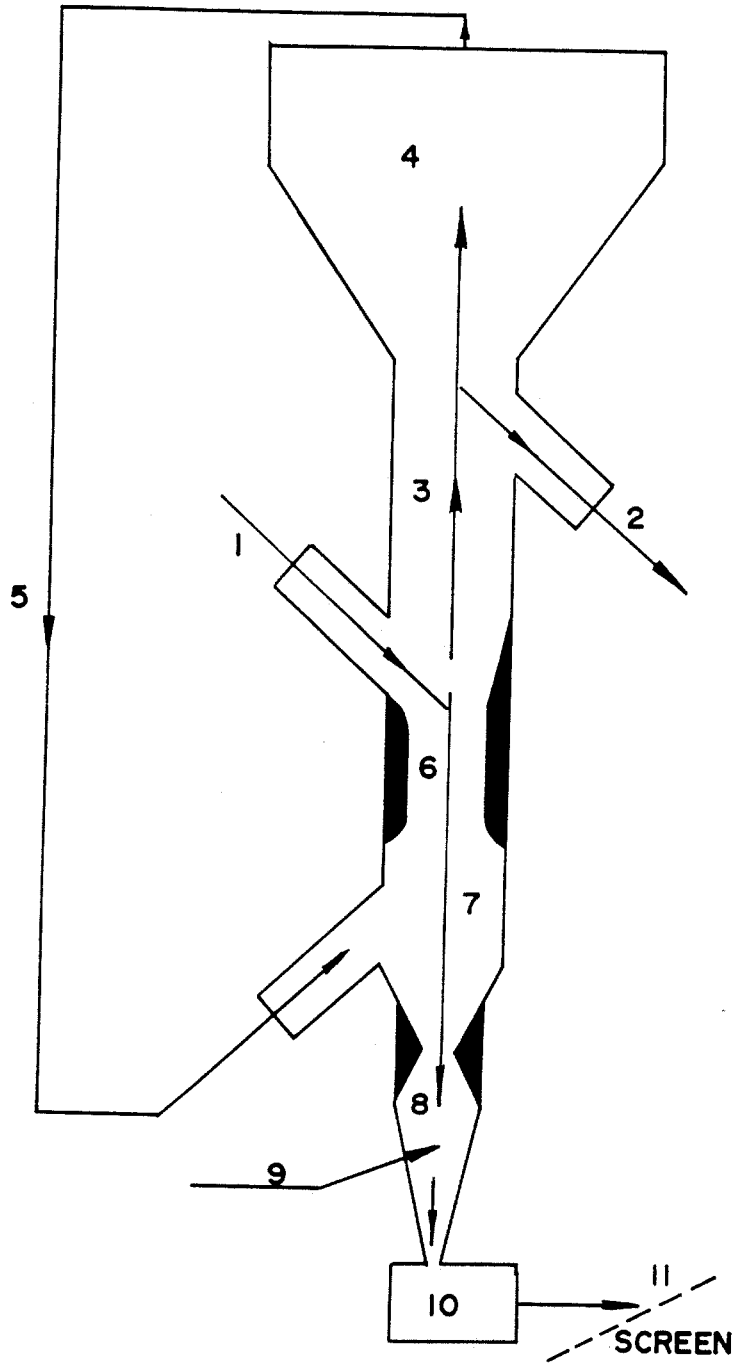
FIG. 2 is a cross sectional schematic view of a typical elutriation column of an example apparatus according to the present invention.

FIG. 2 is a representation of a typical elutriation column as might be employed in conjunction with other similar columns, and additional components as required, to comprise the total apparatus. The column in FIG. 2 is presented by way of example, and should not be considered to embody the only possible method of application of the inventive idea. Changes in such features as the scrubbing technique employed may necessitate changes in the structure of the columns employed. Such changes will be evident to one skilled in the art, and thus will not be described in this specification. Further, it is not necessary that each column in an apparatus consist of all the parts illustrated in FIG. 2, and described below. Slight variations in the application of the inventive idea which may render some components of the column unnecessary in certain instances will be outlined later in this specification.

Each column can be both physically and functionally divided into ten important parts, namely: the inflow line (1), the overflow line (2), the secondary separation section also known as the secondary active portion (3), the primary extraction tank (4), the recirculation circuit (5), the primary active or separation section (6), the primary sedimentation chamber (7), the secondary sedimentation chamber (8), the clean inflow line (9), the solids extraction mechanism (10), and the screen (11). Each part will be described in terms of its contemplated function, and the specific embodiments used to achieve these goals. The inflow line (1) carries the materials to be separated into the system, from the feed hopper (15) in the case of the first column, or from the previous column in all subsequent cases. The solids will generally be suspended in some fluid which acts as the transport medium. In most cases water will serve this purpose. The overflow line (2) forms the inflow line (1) for the subsequent column in all cases, although in the case of the last column, the overflow line (2) will not turn into another inflow line (1) as the series is ending. Communicating with both the inflow line (1) and the overflow line (2) is the secondary separation section (3). This portion comprises the area in which the inflow material is introduced to the vertical flow of the separation medium. The cross-sectional area of this section is selected to be such that the vertical velocity contained within is reduced slightly below that within the primary separation section (6) even when the inflow line (1) is adding material at the normal rate. Immediately above the secondary separation section (3) and communicating therewith is the primary extraction tank (4). It is the purpose of this segment of the apparatus to extract liquid containing small suspended solids which will be used as separation medium from the top of the column. The diameter of this section is selected with relation to the desired characteristics of the separation medium. If the diameter is relatively small, the vertical velocity in this section will be relatively large, thus the separation medium will consist of liquid with relatively large particles suspended in it. On the other hand, if the diameter is increased, the vertical velocity will be decreased, and therefore only relatively smaller particles will be suspended in the separation medium. Fluids extracted from the primary extraction tank (4) are pumped back into the primary sedimentation chamber (7) via the recirculation line (5). As can be seen in FIG. 2, the primary sedimentation chamber (7) is in direct communication with the primary separation section (6) immediately above it, and the secondary sedimentation chamber (8) directly below it. The primary separation section (6) is the section in which the critical flow separation is effected. Thus it is critical that the exact design velocity is maintained in this area. The secondary sedimentation chamber (8) is directly connected to the solids extraction mechanism (10), the primary sedimentation chamber (7), and the clean inflow line (9) which performs the scrubbing of the underflow prior to its removal from the system. In a preferred embodiment, the secondary sedimentation chamber (8) is designed such that the cross sectional diameter of the column entering this section is relatively small. FIG. 2 illustrates a narrowing towards the top of the secondary sedimentation chamber (8) which will cause a relatively flat velocity profile at the narowest point. This reduction in diameter permits the vertical flow rate, necessary to the scrubbing action to be achieved with a minimum of "clean" liquid. Thus the separation medium is not diluted to an excessive degree as the recirculation flow will constitute its major component. A simple alternative to this configuration would be to make the entire length of the secondary sedimentation chamber (8) of relatively small diameter. Although the velocity profile may be adversely affected, the addition of "clean" liquid can still be minimized. Below the solids extraction mechanism (10) is the screen (11) for such columns where a post flow screening step is required (generally for all but the first in the series, as the material is usually screened before being introduced to the flow steps). It should be noted that liquid entering the primary sedimentation chamber (7) will, by design of the column, be forced to rise and act as the separation medium. This is because scrubbing liquid is being added to the secondary sedimenation chamber (8) at a higher rate than the solids extraction mechanism (10) removes the underflow volume. This rising separation medium encounters a smooth but rapid narrowing of the column diameter just as it enters the primray separation section (6). This preferred embodiment provides for a flattening of the velocity profile in order to effect a more precise classification in the primary separation section (6).

Figure 3:
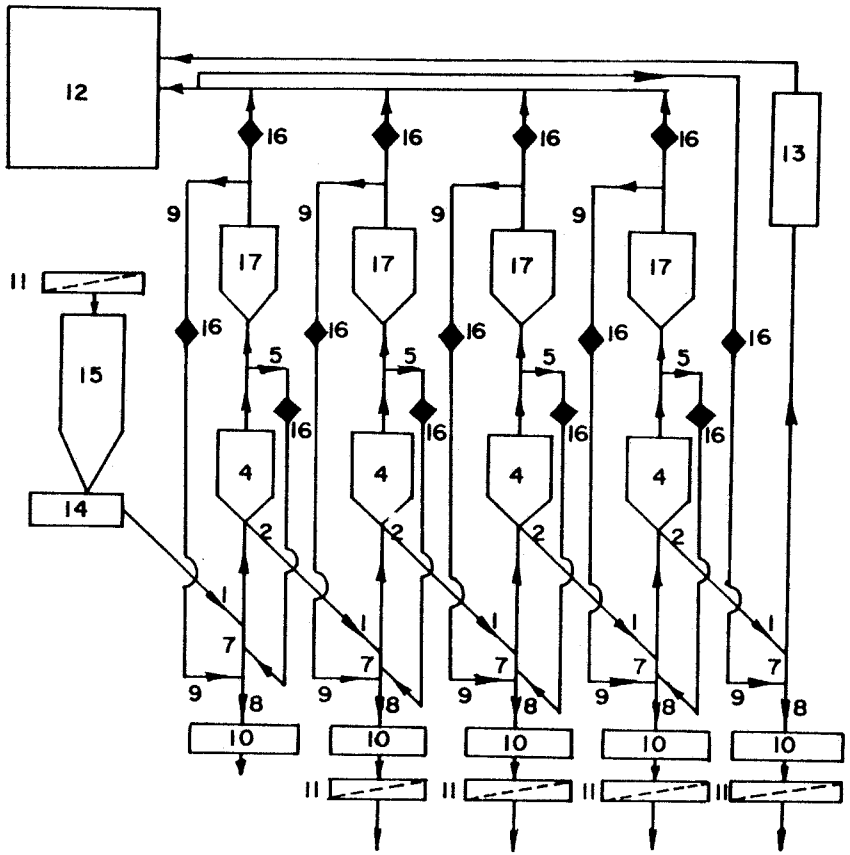
FIG. 3 is a schematic representation of an example five-stage elutriation process and apparatus according to the present invention.

FIG. 3 schematically represents an example application of the process and apparatus as it might be applied to beneficiate a material with characteristics identical to those described in the previous example. It should be noted that the diamond symbol used in FIG. 3 represents a controllable pump such as a variable speed positive displacement pump. A pump, meter,and valve in series might alternatively be employed to perform the required function.

The materials to be separated are first introduced into the system through a feed hopper (15). In general it would be considered expedient to pre-screen the material entering the hopper (15) to some maximum size in order that oversized foreign materials are removed. This can be accomplished through the use of an appropriate size screen (11) covering the entrance to the feed hopper (15). Failure to incorporate this embodiment may result in plugging of the system by oversized foreign objects. The feed hopper (15) itself should be of a size related to the size of the system such that the desired feed rate can be maintained at all times regardless of the technique being used to fill the feed hopper (15). That is to say, the feed hopper (15) must never be empty while the system is in operation, and should therefore be of adequate size so as to accommodate fluctuations in the rate at which material is added to it. Furthermore, the geometry of the feed hopper (15) should prevent bridging of the material which could result in a cessation of material inflow. In general this means that the smallest dimension of the feed aperture should be at least five times the diameter of the largest particle size, or in this specific case, at least five times the aperture diameter of the screen covering the feed hopper (15). Also the slope angle of the feed hopper (15) should be great enough to ensure adequate wall slippage.

Material to be introduced into the separation system should be extracted from the feed hopper (15) at a constant volume per unit time. A progressive cavitation pump such as a Moyno (Registered Trademark of Robbins and Meyers Inc.) may be suitable for this purpose. In order to reduce wear in this feed pump (14), and ensure consistent inflow characteristics, the material in the feed hopper (15) should be wetted to the saturation point. By adding excess liquid to the feed hopper (15), such that the excess sits on top, the material at the point of extraction will be saturated. Liquid from the main holding tank (12) would be suitable for this purpose, and through this pre-wetting, the solids to liquids ratio of the material entering the system is known and constant. Knowing that the inflow material is saturated removes any doubt regarding characteristics of the inflow material, and facilitates accurate dilution. The pumpin action of the feed pump (14) also should break down agglomerated particles into their smaller constituents. This is important as agglomerates will erronously settle out early in the separation system due to their large size, when in fact the particulate constituents should settle out later in the system.

Material leaving the feed pump (14) must then be diluted in order that the particles can settle against the separation medium relatively independently of one another once in the primary and secondary separation sections (6) and (3), respectively. The flow of separation medium will also contribute to the required dilution effect, thus the entire dilution need not be achieved in the inflow line (1) for the first column in the series. In general, material in the inflow line (1) need not be more than roughly 50 percent solids by volume. However this may vary somewhat dependent on the design velocity in the initial column.

The particulate solids entering any given elutriation column as inflow can be conceptually divided into those particles which will eventually sink out as underflow, and those which will leave that column as overflow. Hereinafter for the purpose of this example, particles which will eventually constitute the underflow for a given column will be referred to as underflow while in any portion of said column. The term overflow will be used with similar intent hereinafter. In order to facilitate adequate comprehension of the embodiments of this process and apparatus, such embodiments shall be discussed with relation to their contemplated function, as the path of the underflow then the overflow is outlined throughout the system.

The particles which will eventually comprise the underflow fraction from the first column enter the first column via the inflow line (1) as described above. The inflow line (1) flows down into the lower portion of the secondary active portion (3), forming an acute angle between the two. As mentioned previously, the volume of the inflow is selected with relation to the cross-sectional area of the secondary separation section (3), and the desired size/density characteristics of the underflow for that specific column, such that the net vertical velocity in the secondary separation section (3) is slightly less than that in the primary separation section (6). The rationale inherent in this slight reduction in vertical velocity is to ensure that underflow particles caught up in the turbulence due to the inflow mixing with the separation medium in the secondary separation section (3) will eventually settle back down to the primary separation section (6). The vertical flow velocity in the secondary separation section (3) should generally be no more than 95 percent of the design velocity for that column, where the design velocity for the column refers to the vertical velocity in the primary separation section (6). In cases where the overflow line (2) is in close proximity to the inflow line (1), the velocity should be further reduced as the turbulence effects may still be largely undiminished at the overflow line (2). Obviously the vertical separation between the inflow line (1) and the overflow line (2) can be reduced when dealing with the lower flow rates. Although such reductions decrease the size of the apparatus, they serve no other functional purpose, and therefore are not generally employed at this inclusion would preclude standardization of the components of the system. Excessive reduction of the vertical velocity in the secondary separation section (3) with respect to the design velocity will result in a net increase in the percent solids in the secondary separation section (3). This effect is due to the larger fraction of solids with size/density characteristics such that they cannot settle out as underflow, but, due to the lower flow rate in the secondary separation section (3) some particles will be quite slow to be exhausted as overflow. Thus, the net effect of a substantial velocity reduction in the secondary separation section (3) is an increase in liquid density within this area. As mentioned earlier, this effect will result in better density selectivity in the secondary separation section (3) due to the decrease in the $(\rho s-\rho l)$ term in the applicable sedimentation equation. On the other hand, if the density gets too high in the secondary separation section (3), plugging is more probable, and the associated increase in viscosity can both complicate the settling characteristics of particles (due to accentuations of deviations in settling rate as caused by variations in particle surface area versus mass based on particle shape, etc.), and increased power consumption related to the recirculation pumps (16) required in the system. For these reasons, the velocity in the secondary separation section (3) should generally not be less than 70 percent of the design velocity for that specific column.

Immediately below the secondary separation section (3) and communicating directly therewith is the primary separation section (6). As indicated by the name, the function of this section is to effect the critical flow related separation. Thus it is of paramount importance that the precise design velocity is maintained throughout the entire cross-section of this segment of the apparatus. To this end, the ideal geometry embodied to accomplish this consists of a cylindrical shape (to minimize wall friction in relation to cross-sectional area) and a smooth but rapid narrowing of the cross-sectional area at the lowermost end of the primary separation section (6). This second feature serves to flatten the velocity profile through the section immediately above it, and therefore aids in effecting a precise separation at this point. With respect to the vertical length of the primary separation section (6), the selected length must be adequate to ensure that the net downward velocity of the inflow is effectively nullified, with enough additional length in which to perform the required flow separation. Should this additional length substantially exceed the required amount, the underflow particles will have an inordinately large residency time within this section. This will manifest itself in a greater proportion of the solids occupying the separation area, and thus by effectively reducing said area, the design velocity will be increased. The net effect of excessive length of this section is to cause the underflow to precipitate in waves. The reason for this phenomenon is that the area reduction mentioned above tends to result in an increase in the vertical velocity which clears most of the solids out of the area; the velocity then deceases in response, and another wave begins to settle out until the area is again overfilled with solids. This will result in a cycle which repeats itself with a period proportional to the excess length of this component. Associated with this oscillation about the desired dynamic equilibrium within the system will be a slight decrease in the separation precision of the system. The two methods to reduce or eliminate this oscillatory phenomenon are to reduce the feed rate to the extent that the effective area reduction caused by sedimenting particles is not appreciable enough to cause the oscillation, or simply to shorten the length of the primary separation section (6) to the extent that the period of the oscillation becomes so short that it effectively disappears. For economic reasons, the latter solution is favored over a reduction in the feed rate to the system.

Immediately below the primary separation section (6), and directly communicating therewith is the primary sedimentation chamber (7). It is via the recirculation circuit (5), which connects with the primary sedimentation chamber (7) that the separation medium enters the column. Due to the design of this sysem this recirculation flow results in a positive vertical velocity within the primary separation section (6). The primary sedimenation chamber (7) embodies a somewhat larger cross-sectional area than the primary separation section (6) and thus has a lower vertical velocity within. Therefore once any underflow particles have reached this portion of the apparatus, they will settle relatively unhindered to the solids extraction mechanism (10). Below the primary sedimentation chamber (7) and communicating therewith is the substantially narrower secondary sedimentation chamber (8). In order to prevent the small solids suspended within the separation medium from settling to the solids extraction mechanism (10), a slight vertical flow of "clean" liquid (where, as before, "clean" is defined as liquid with an acceptably low percentage of solids suspended in it) is maintained by the "clean" scrubbing liquid entering this segment via the clean inflow line (9). The vertical velocity of the scrubbing liquid leaving this area of the apparatus must exceed that in the primary extraction tank (4) from which the recirculation flow is derived, however it can be substantially lower than the design velocity for that specific column. It should be remembered that while the small upper diameter of the secondary sedimentation chamber (8) does not require a large volume per unit time to generate this flow, the liquid which is being extracted by the solids extraction mechanism (10) must be replaced in this zone. Given that the vertical velocity exiting the secondary sedimentation chamber (8) falls within the above guidelines, the underflow will easily settle to the solids extraction mechanism (10), but the suspended particles within the separation medium will not, hence the scrubbing will be effective.

When dealing with very fine solids, (ie. less than 100 mesh) the clean inflow may be proportionally increased such that it can generate the design velocity independent of the recirculation flow, thereby precluding the need for scrubbing. In such cases, the clean inflow line (9) must be transposed to enter the column where the recirculation circuit (5) normally enters, as introduction at the usual point would result in the vertical velocity within the secondary sedimentation chamber (8) exceeding the design velocity by virtue of its small diameter. Obviously failure to eembody this change, which is illustrated in the final column of FIG. 3, could result in no solids being able to underflow from the column. It should be noted that in this situation the secondary sedimentation chamber (8) becomes a vestiginal embodiment which may be omitted.

Finally, the underflow for a given column reaches the solids extraction mechanism (10) where the particles are removed from the column. Invariably a small amount of liquid will be removed with these solids; however it is best to minimize these liquid losses as they must be made up for by the clean inflow. The solids extraction mechanism (10) could be a positive displacement pump capable of removing the solids without plugging, or some form of discharge control valve could be employed thereby decreasing the risk of particle breakdown during extraction.

The solids extraction mechanism (10) discharges the fraction to be screened to the screen (11) for that colunn. As mentioned earlier, and as illustrated in FIG. 3, in certain cases, the screening operation will not be required as the entire underflow fraction will consist of the high density material. The aperture size for the screen employed will be selected relative to the design velocity for the specific column based on the guidelines described earlier. In the case of this example where the higher density material is being sought, the undersized underflow will constitute the concentrate, and the oversize will be the low density waste product. As the screening step embodies no new or exceptional technology it will not be described further in this disclosure.

Having described the path through the system taken by the underflow of any given column, the overflow shall now be discussed in a similar fashion.

The majority of the overflow entering the secondary separation section (3) via the inflow line (1) is carried up by the separation medium, and leaves the column via the overflow line (2). It will be remembered however that the vertical velocity within the secondary separation section (3) is slightly less than the design velocity, thus there will be a small number of particles with size/-density characteristics such that they cannot be carried up as immediate overflow, nor can they settle out as underflow. These retained particles will accumulate in the secondary separation section (3) of the apparatus slowly increasing the effective liquid density therein until such time as the density increase is sufficient to bring about the overflow of the very particles causing it. The prime function of this section (that is to prevent the erroneous overflow of any underflow particles) will still be accomplished in spite of the density increase which will occur for a time after initial system startup. This is due to the fact that the $(\rho s-\rho l)$ term in the sedimentation equations will have a greater effect on the lower density particles resulting in preferential overflow of the low density particles. The net result is that any underflow particles which are erroneously overflowed will most likely be composed of the lower density waste material, therefore, the selectivity of the system will not be adversely affected by such mistakes.

Some overflow material will be carried up into the primary extraction tank (4) from which the recirculation flow originates. This portion of the overflow is temporarily held in the column to act as the weighting agent in the separation medium. Theoretically, any given particles could remain in this loop within the column. For practical purposes, however, the system will equilibrate soon after initial startup such that the inflow of particles of this class is equalled by the overflow rate of such particles, hence this loop cannot be considered infinite.

FIG. 3 further illustrates secondary extraction tanks or zones (17) which are incorporated in order that the inflow volume to each column does not increase, but can in fact be made to decrease. The importance, and need for this has been earlier outlined herein. The design of these tanks is such that only an acceptably small amount of solids are removed with the liquid extracted. Thus a large diameter, and a low extraction rate are recommended. In a preferred embodiment, the secondary extraction tanks could be hydrocyclones incorporated into the recirculation circuit such that the fraction discharged through the apex would enter the primary sedimentation chamber (7) via the recirculation circuit (5), and be used as the separation medium; the fraction discharged through the vortex could be used as scrubbing liquid, and could be introduced into the secondary sedimentation chamber (8) via the clean inflow line (9), or diverted out of the system to reduce the overflow volume. The fluid extracted from these secondary extraction tanks (17) can be used as "clean" scrubbing liquid, returned to the main holding tank (possibly by way of the thickener (13)) or dealt with in any other desirable manner. In general, the fine solids recovered by the thickener (13) constitute waste material, and would be discarded with the waste fractions from the screening steps.

The final discharge of overflow fines which are not introduced into another separation unit may be returned to the main holding tank (12) by way of a thickener (13) as is illustrated in FIG. 3. This will allow for the recovery of the liquids used where this is desirable. Each column need not be equipped with its own recirculation circuit. In some cases the separation can be effected entirely with clean liquid (especially where the flow rate is small) as is illustrated in the final column of FIG. 3. Another possibility would be to extract additional volumes from the primary extraction tank (4) of one column in order to supply separation medium for the adjacent columns. Here again the primary extraction tank (4) must be designed such that the liquid extracted has the desired characteristics to be used as separation medium for all those columns in which it is employed. Similarly, the secondary extraction tanks (17) need not be associated with each and every column in the system. In the case of the secondary extraction tanks (17) the parameters dicating the minimum frequency of their occurrence is the acceptability of the ratio of the vertical flow rates within the primary and secondary separation sections (6) and (3) respectively for all the columns involved.

Figure 4:
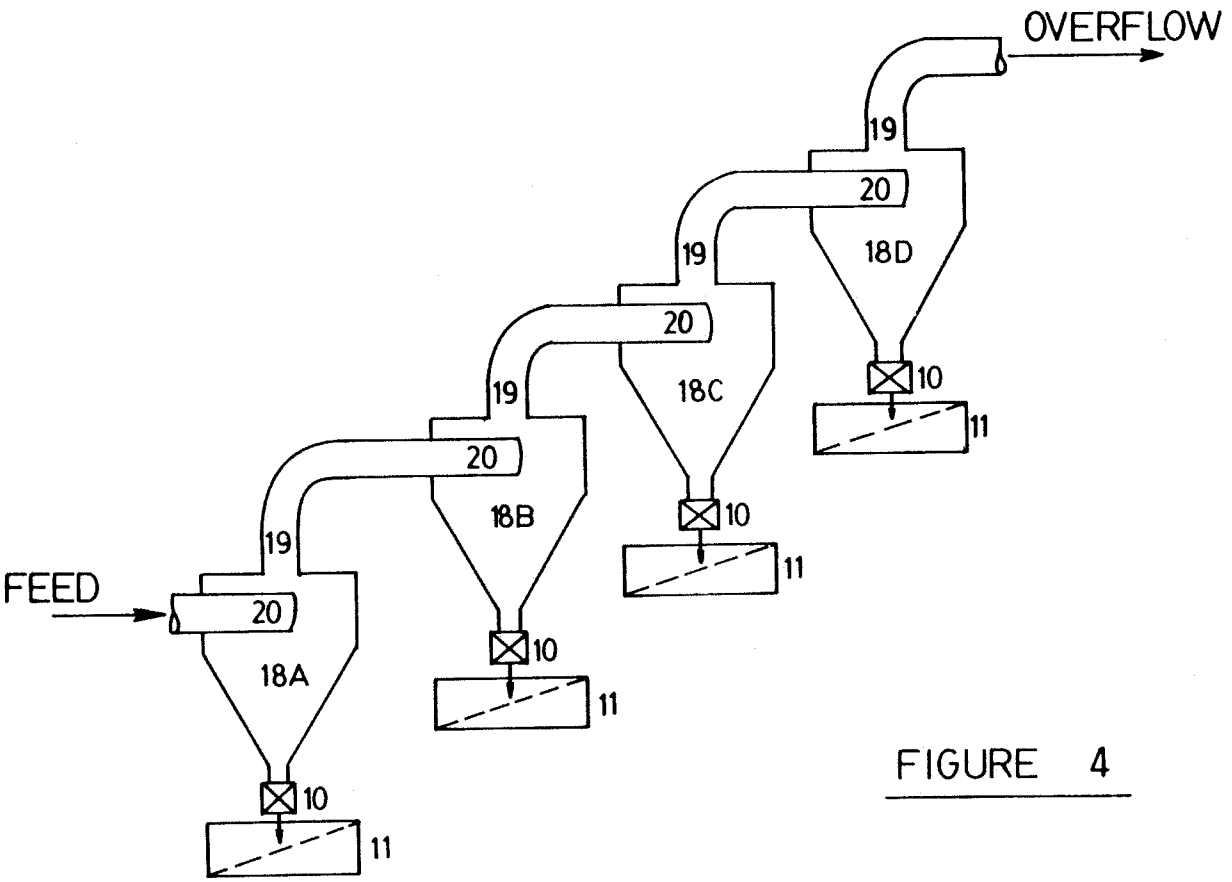
FIGS. 4 and 5 are schematic representations of possible apparatus configuations employing hydrocyclones as the counterflow separation units in the process and apparatus according to the present invention.
Figure 5:
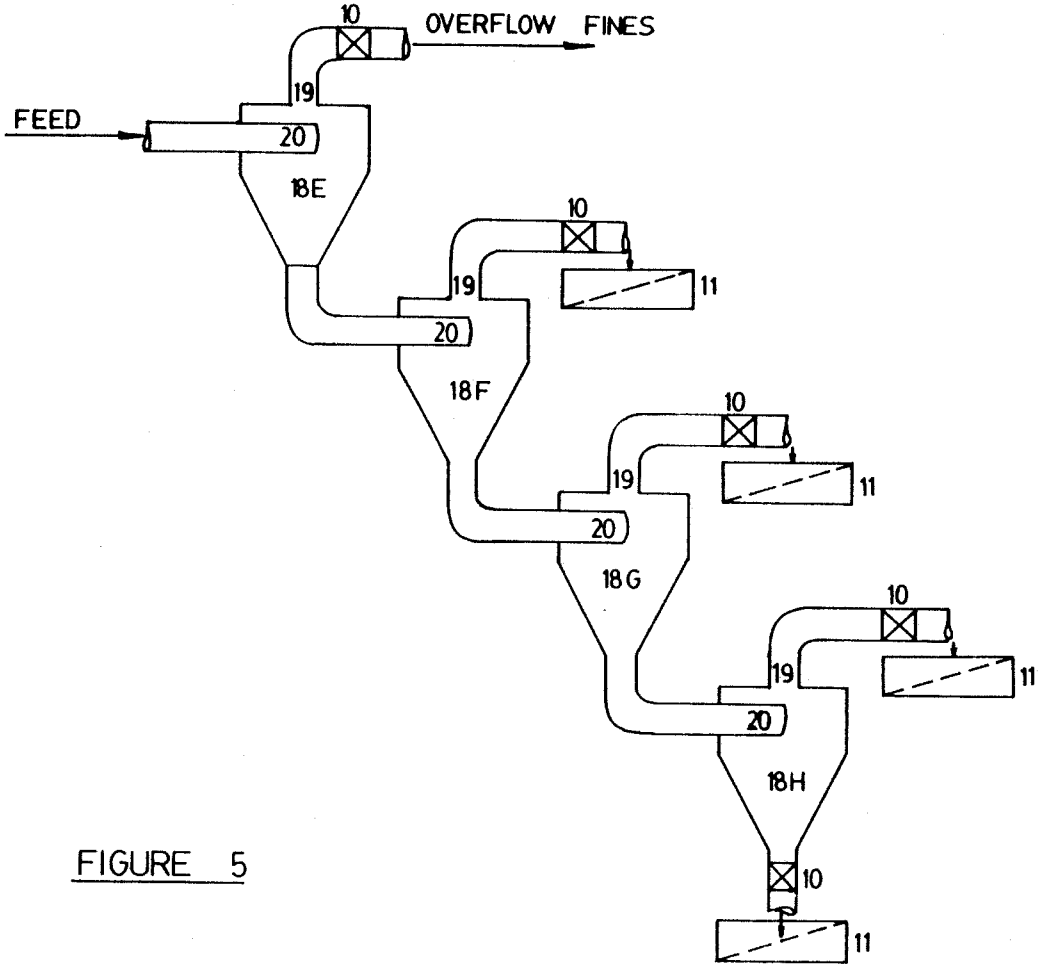

FIGS. 4 and 5 illustrate two possible methods for the serial connection of the counterflow separation units, which are represented as hydrocyclones (18) in these drawings. In both cases it should be noted that the feed may come directly from a column at the end of a series of columns, or in the case of very fine materials which can be separated according to this process without columns, the hydrocyclone series can be fed directly by some form of screen/hoppper/feed pump assembly. In the latter case the screens (11) associated with hydrocylones (18A) or (18H) would not be required as the aforementioned feed system would have a screen incorporated. In order to control the parameters of the separations performed by the hydrocyclones (18) a solids extraction mechanism (10) which could vary the extraction rate could be employed. A variable speed positive displacement pump, or some form of adjustable valve could be used to serve this purpose. Further control over the separation can be achieved by modifying the diameter of the "tangential inlet" (2). The diameter of the "vortex discharge aperture" (19) is not critical as in all cases the solids extraction mechanism will dictate the flow rate through the vortex discharge aperture (19). FIG. 4 embodies a serial connection wherein the overflow is the flow fraction which is introduced into the next separation unit, and the screens addressing the underflow grow progressively finer as the series progresses. The apparatus of FIG. 5 on the other hand is connected such that the underflow fraction is introduced via the tangential inlet (20) to the next unit in the series. In this case the screens used to address the overflow fractions produced will employ progressively coarser mesh as the series continues.

Thus it is apparent that there has been provided in accordance with the invention an apparatus for separating mixtures of particulate materials that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A process for separating mixtures of particulate materials according to particle density comprising passing the particulate materials through a series of counterflow separation units in association with screening operations, each said counterflow separation unit producing underflow and overflow fractions, extracting liquid bearing solids in suspension from the overflow fraction from one or more of said counterflow separation units and reintroducing said extracted liquid bearing solids in suspension in whole or in part as a separation medium providing the counterflow in one or more of said counterflow separation units, causing the average counterflow rate to differ in a progressive fashion from separation unit to separation unit throughout the series in order to produce flow fractions with sedimentation velocities progressively differing from separation unit to separation unit throughout the series, introducing a similar one of said underflow or overflow fractions into the next separation unit in the series while subjecting the remaining fraction to a screening operation utilizing one or more screen mesh sizes selected according to the counterflow rate within the respective counterflow separation unit to pass particles above a selected density, but to retain those particulate materials below that density.

2. A process according to claim 1 wherein said counterflow separation units include a series of elutriation column units, the underflow fraction from each column unit being introduced to the next column unit in the series, providing a vertical upward vertical flow rate of the separation medium in each column unit having a higher average vertical velocity than that in the previous column unit, said vertical velocity for each column unit being selected such that materials of increasing size are contained in the underflow of each successive column unit, the overflow from each column unit other than the first column unit being subjected to the screening operation utilizing screen mesh sizes growing progressively larger through the series and being selected according to the vertical flow rate in order to pass particles with a density above a selected cutoff density, but to hold those particles below that density, one or more column units in the series employing a primary extraction zone where liquid bearing solids in suspension are extracted and employed in whole or in part as the separation medium within the system.

3. A process according to claim 1 wherein each unit is provided with a primary separation zone and a secondary separation zone immediately thereabove, the overflow fraction from each unit except the last being introduced into a lower portion of the secondary separation zone of the next unit.

4. A process according to claim 3 wherein each unit is provided with a primary sedimentation zone located below the primary separation zone, and a primary extraction zone for extracting said liquid bearing solids in suspension, liquid from the primary extraction zone of one or more units is recirculated and reintroduced into one or more of the primary sedimentation zones located below the primary separation zones.

5. A process according to claim 4 wherein a secondary sedimentation zone is located immediately below and directly communicating with the primary sedimentation zone and wherein a flow of liquid having an acceptably small amount of solids contained therein is introduced into the secondary sedimentation zone to effect a vertical upwards velocity of sufficient magnitude that it prevents small weighting solids in the separation medium from settling into the underflow from each unit, whereby the underflow from each unit is thereby scrubbed.

6. A process according to claim 3 wherein a primary sedimentation zone is provided located below the primary separation zone and wherein a secondary sedimentation zone is provided immediately below and directly communicating with the primary sedimentation zone and wherein a flow of liquid having an acceptably small amount of solids contained therein is introduced into the secondary sedimentation zone to effect a vertical upwards velocity of sufficient magnitude that it prevents small weighting solids in the separation medium from settling into the underflow from each unit, whereby the underflow from each unit is thereby scrubbed.

7. A process according to claim 2 wherein one or more units of the system are provided with a secondary extraction zone communicating with and located between the primary extraction zone and the column, extracting liquid from the secondary extraction zone of the unit having acceptably small amounts of solids contained therein, and using said liquid for scrubbing purposes within the system or removing said liquid from the unit to decrease the volume of overflow within the system.

8. A process according to claim 1 wherein the underflow from each of one or more of the units is subjected to a series of screening operations using progressively smaller screen apertures such that multiple density fractions are produced.

9. A process for separating mixtures of particulate materials according to particulate density comprising passing the particulate materials through a series of counterflow separation units in association with screening operations, said counterflow separation units including a series of elutriation column units, each column unit producing underflow and overflow fractions, introducing the overflow fraction from each column unit to the next unit in the series, causing the average counterflow rate to differ in a progressive fashion from column unit to column unit throughout the series by providing a separation medium in each column unit which has a lower average vertical velocity than that in the previous unit, said vertical velocity for each column unit being selected such that materials of decreasing size are contained in the underflow of each successive column unit, the underflow from each column unit excepting the first unit being subjected to a screening operation uilizing screen mesh sizes growing progressively smaller through the series and selected according to the vertical flow rate in order to pass particles with a density above a selected cutoff density, but to retain those particles below the cutoff density, one or more column units in the series including a primary extraction zone where liquid bearing solids in suspension are extracted and employed in whole or in part as the separation medium within the system, wherein the separation medium is partially weighted by the addition of a soluble material to the liquid being used as the separation medium.

10. A process for separating mixtures of particulate materials according to particulate density comprising passing the particulate materials through a series of counterflow separation units in association with screening operations, said counterflow separation units including a series of elutriation column units, each column unit producing underflow and overflow fractions, introducing the overflow fraction from each column unit to the next unit in the series, causing the average counterflow rate to differ in a progressive fashion from column unit to column unit throughout the series by providing a separation medium in each column unit which has a lower average vertical velocity than that in the previous unit, said vertical velocity for each column unit being selected such that materials of decreasing size are contained in the underflow of each successive column unit, the underflow from each column unit excepting the first unit being subjected to a screening operation utilizing screen mesh sizes growing progressively smaller through the series and selected according to the vertical flow rate in order to pass particles with a density above a selected cutoff density, but to retain those particles below the cutoff density, one or more column units in the series including a primary extraction zone where liquid bearing solids in suspension are extracted and employed in whole or in part as the separation medium within the system, wherein the vertical flow of the separation medium is pulsed in order to increase the density sensitivity of the separation.

11. An apparatus for separating particulate high density materials from associated particulate lower density materials comprising a plurality of elutriation column units in a series, the units being provided with means to pass the overflow from each unit into the next unit of the series, and means to progressively vary the average vertical flow rate in each successive unit, each unit being provided with an outlet for underflow, means being provided to collect the underflow from each unit, a screen being associated with each unit in the series besides the first unit, the screen mesh size varying progressively through the series and being selected according to the average vertical flow rate in order to pass higher density particulate materials but retain the lower density particulate materials, one or more units in the series employing a primary extraction tank from which liquid bearing solids in suspension is extracted and employed in whole or in part as a separation medium within the system, each such unit being also provided with a primary separation section and a secondary separation section immediately thereabove, the primary separation section having a narrowed column diameter to provide a flattening of the velocity profile of the separation medium and effect a more precise classification in that primary separation section.

12. An apparatus according to claim 11 wherein the secondary operation section has a larger diameter than that of the primary separation section.

13. An apparatus for separating particulate high density materials from associated particulate lower density materials comprising a pluraltiy of elutriation column units in a series, the units being provided with means to pass the overflow from each unit into the next unit of the series, and means to progressively vary the average vertical flow rate in each successive unit, each unit being provided with an outlet for underflow, means being provided to collect the underflow from each unit, a screen being associated with each unit in the series with the exception of the first unit, the screen mesh size varying progressively through the series and being selected according to the average vertical flow rate in order to pass higher density particulate materials but retain the lower density particulate materials, each column unit including a primary separation section with a secondary separation section immediately thereabove, and a primary sedimentation chamber and a secondary sedimentation chamber, the primary sedimentation chamber being in direct communication with the primary separation section and being positioned immediately below it, and the secondary sedimentation chamber being directly below the primary sedimentation chamber, one or more column units in the series employing a primary extraction tank from which liquid bearing solids in suspension are extracted and employed in whole or in part as a separation medium within the system.

14. An apparatus according to claim 13 wherein the primary sedimentation chamber has a larger cross-section area than the primary separation section, thus producing a lower vertical velocity within.

15. An apparatus according to claim 13 wherein liquid from the primary extraction tank is recirculated through the column and reintroduced to the column at the level of the primary sedimentation chamber.

16. An apparatus for separating particulate high density materials from associated particulate lower density materials comprising a plurality of elutriation column units in a series, the units being provided with means to pass the overflow from each unit into the next unit of the series, and means to progressively vary the average vertical flow rate in each successive unit, each unit being provided with an outlet for underflow, means being provided to collect the underflow from each unit, a screen being associated with each unit in the series with the exception of the first unit, the screen mesh size varying progressively through the series and being selected according to the average vertical flow rate in order to pass higher density particulate materials but retain the lower density particulate materials, one or more units in the series employing a primary extraction tank from which liquid bearing solids in suspension are extracted and employed in whole or in part as a separation medium within the units, and a secondary extraction tank communicating with and located between the primary extraction tank and the columns, the secondary extraction tank operating to extract liquid which has an acceptably small amount of solids contained therein from the column to be used for scrubbing purposes within the unit or removed from that unit in order that a decrease in the overflow volume be achieved.

17. An apparatus according to claim 16 wherein the secondary extraction tanks are hydrocyclones.

* * * * *